United States Patent [19]

Ross

[11] Patent Number: 4,657,244

[45] Date of Patent: Apr. 14, 1987

[54] EXERCISE BICYCLE

[75] Inventor: Sherwood B. Ross, No. Miami, Fla.

[73] Assignee: Ross Bicycles, Inc., Rockaway Beach, N.Y.

[21] Appl. No.: 892,788

[22] Filed: Jul. 31, 1986

[51] Int. Cl.[4] ..... A63B 21/00

[52] U.S. Cl. ..... 272/73; 74/48

[58] Field of Search ..... 272/73, 97, 71, 72, 272/116, 131, 132, 134; 74/47, 48, 571

[56] References Cited

U.S. PATENT DOCUMENTS

| | | | |
|---|---|---|---|
| D. 216,903 | 3/1970 | Rubel | D34/5 |
| 251,398 | 12/1881 | Amess | 74/47 |
| 254,082 | 12/1882 | Wiard | 74/47 |
| 326,247 | 9/1885 | Root | 272/71 |
| 1,409,992 | 3/1922 | Armstrong . | |
| 1,872,256 | 4/1931 | Denney . | |
| 1,909,002 | 5/1933 | Oehlberg . | |
| 2,032,303 | 2/1936 | Orgitano | 128/25 |
| 2,107,447 | 2/1938 | Marlowe | 272/73 |
| 2,107,449 | 12/1935 | Marlowe | 128/33 |
| 2,261,355 | 11/1941 | Flynn | 128/25 |
| 2,453,771 | 11/1948 | White | 128/25 |
| 2,565,348 | 8/1951 | Brockman | 128/25 |
| 2,825,563 | 5/1955 | Lawton | 272/79 |
| 2,872,191 | 3/1959 | Gallo | 272/73 |
| 3,017,180 | 1/1962 | Aronsohn | 272/58 |
| 3,024,023 | 3/1962 | Steller | 272/73 |
| 3,112,108 | 11/1963 | Hanke | 272/58 |
| 3,134,378 | 5/1964 | Harwood | 128/25 |
| 3,213,852 | 10/1965 | Zent | 128/25 |
| 3,216,722 | 11/1965 | Odom | 272/73 |
| 3,381,958 | 5/1968 | Gulland | 272/79 |
| 3,572,699 | 3/1971 | Nies | 272/73 |
| 3,745,990 | 7/1973 | Neis | 272/73 |
| 3,758,111 | 9/1973 | Agamian | 272/73 |
| 3,824,993 | 7/1974 | Grant | 128/25 |
| 3,930,495 | 1/1976 | Marino, Jr. | 128/25 |
| 3,940,128 | 2/1976 | Ragone | 272/73 |
| 3,964,742 | 6/1976 | Carnielli | 272/73 |
| 3,966,201 | 6/1976 | Mester | 272/73 |
| 3,979,113 | 9/1976 | Uhl | 272/73 |
| 4,071,235 | 1/1978 | Zent | 272/73 |
| 4,222,376 | 9/1980 | Praprotnik | 128/25 |
| 4,300,760 | 11/1981 | Bobroff | 272/120 |
| 4,402,502 | 9/1983 | Peters | 272/73 |
| 4,423,863 | 1/1984 | Figueroa | 272/73 |
| 4,438,921 | 3/1984 | Szymaki | 272/73 |
| 4,451,033 | 5/1984 | Nestegard . | |
| 4,572,501 | 2/1986 | Durham | 272/73 |
| 4,582,318 | 4/1986 | Giannelli | 272/73 |

FOREIGN PATENT DOCUMENTS

| | | |
|---|---|---|
| 462920 | 8/1973 | Australia . |
| 994823 | 1/1976 | Canada . |
| 517774 | 2/1931 | Fed. Rep. of Germany . |
| 779363 | 4/1935 | France . |
| 1194046 | 6/1970 | United Kingdom . |

*Primary Examiner*—Richard J. Apley
*Assistant Examiner*—S. R. Crow
*Attorney, Agent, or Firm*—Lilling & Greenspan

[57] ABSTRACT

The invention includes a conventional exercise bicycle with foot pedals, a chain drive system and a flywheel. Rotating with the flywheel is a first gear which is in mesh with a second larger gear. Located on the face of the second gear, but offset from the center of the gear, is an eccentric which supports reciprocating arms. Movement of the reciprocating arms by the exerciser causes rotation of the second and first gears and, consequently, the flywheel.

7 Claims, 4 Drawing Figures

EXERCISE BICYCLE

BACKGROUND OF THE INVENTION

This invention relates to an improved type of exercise bicycle, which is capable of providing exercise for not only the muscles of the leg, but also muscle groups in the upper part of the body. Most exercise bicycles simulate bicycles and provide exercise for only the muscles of the legs and the lower torso. Activities such as jogging and running, however, may be considered to be more beneficial than cycling, because they involve more muscle groups and place a greater cumulative demand on the aerobic system of the body.

Accordingly, in recent years there has been a need for a bicycle type exerciser which operates as a conventional exercise bicycle, but is also capable of providing exercise for muscle groups in the upper part of the body.

One particular cycle exerciser that has been marketed in recent years by Schwinn is protected by Hooper (U.S. Pat. No. 4,188,030). In the Hooper cycle exerciser, in addition to the conventional pedals 18 and 20, the cycle exerciser also includes elongated levers 28 with handgrips 32. The elongated levers 28 can pivot about the wheel axle 15, and the person using the bicycle can thus obtain exercise of the muscles in the upper part of the body. These elongated levers 28 are connected by means of drive bars 34 to the crank ring 35 which causes rotation of the energy-absorbing wheel 5.

This invention affords another type of exercise bicycle which can provide exercise for both the lower and upper part of they body, but which uses a different system for mounting the arm levers.

SUMMARY OF THE INVENTION

The exercise bicycle of this invention is constructed in the manner of a conventional exercise bicycle with foot pedals, a chain drive system and a flywheel. Extending outward from the axle of the flywheel is a first gear which rotates with the flywheel. A second gear is positioned so as to mesh with the first gear. Located on the face of the second gear, but offset from the center of the gear, is an eccentric which supports reciprocating arms. Movement of the reciprocating arms by the exerciser will cause rotation of the second and first gears and, consequently, the flywheel. Thus, the instant exercise bicycle will also provide exercise for the upper part of the body, as well as the lower part of the body.

BRIEF DESCRIPTION OF THE DRAWINGS

1.

2.

3.

4.

DETAILED DESCRIPTION OF THE INVENTION

The reciprocating arm levers construction of this invention can be attached to any conventional exercise bicycle.

Figure 1:
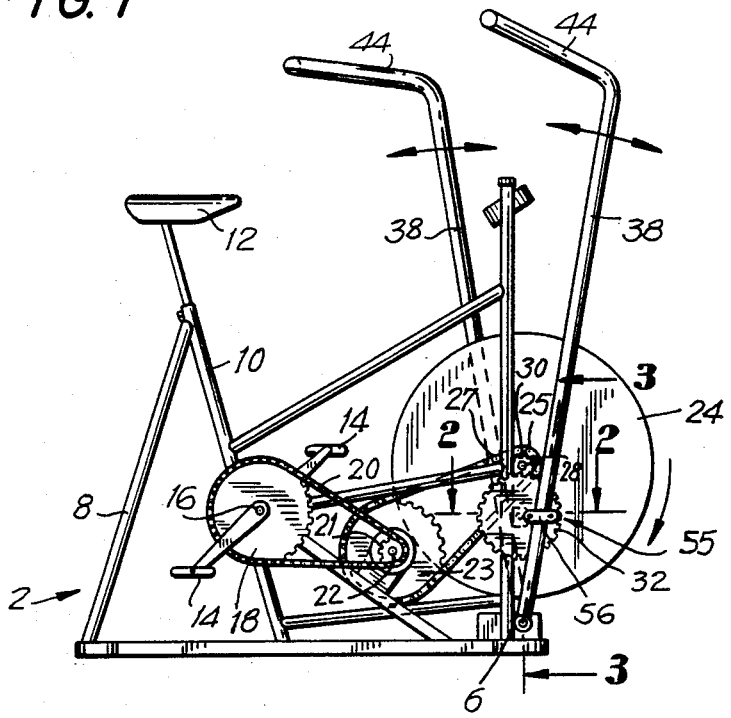
FIG. 1 is a right-side, elevational view of the invention.

The typical exercise bicycle would include a frame 2, comprising a base 4, a front support 6, a rear support 8, a seat support 10 and the seat itself 12. An example of one typical type of exercise bicycle is disclosed in Hooper (U.S. Pat. No. 4,188,030). The frame may be made of tubes, as shown in FIG. 1, or it may be made of plates or other structures which will provide a solid support for the exercise bicycle. Preferably the frame will be made of metal, but some plastics or alloy materials may also prove to be suitable. Any conventional bicycle seat or exercise bicycle seat may be used on the exercise bicycle.

The exercise bicycle also includes right and left foot pedals 14, which are mounted in the usual fashion. Rotation of the foot pedals 14 by the user of the exercise bicycle causes rotation of the main drive shaft 16 and the primary sprocket 18. A chain 20 is passed over the sprocket 18 at one end and on the other end it is connected to a secondary sprocket 22. The secondary sprocket is mounted on the surface of a second primary sprocket 23 and a second secondary sprocket 25 is attached to the front energy-absorbing wheel (or flywheel) 24. A second chain 27 connects the second primary sprocket 23 and the second secondary sprocket 25. Thus, pedalling by the user of the exercise bicycle will cause rotation of the primary sprocket 18 and, consequently, the chain drives 20 and 27 and the sprockets 22, 23 and 25, which causes rotation of the flywheel 24. Any of the conventional other systems that are currently in use for exercise bicycles may also be used to link the pedals to the front flywheel 24. In some situations, it may be desirable to use only one chain drive and to connect the first secondary sprocket directly to the front flywheel. In most instances, it will be desirable to place chainguards over the chains in order to prevent the user of the exercise bicycle from getting dirty or getting his clothes or body caught in the chains.

The front energy absorbing wheel 24 may be of any conventional type that are typically used on exercise bicycles. It may be a solid disk, as shown in FIG. 1, or it may be of a cage-like structure, as shown in Hooper.

If desired, a speedometer and/or odometer may be connected to the front wheel in order to provide appropriate read-outs to the user. Any other electronic devices, such as clocks or stopwatches, etc. may also be attached, as is commonly known.

The front wheel 24 rotates about an axle 26 whose distal ends 28 extend out of the right and left side of the front wheel 24. On each of the ends 28 of the axle a small pinion gear 30 is mounted. The axle 26 is designed to rotate with the front wheel 24, so that the pinion gear 30 will also rotate as the front wheel 24 rotates.

The front support of the bicycle includes two upright vertical supports 6, one on each side of the flywheel 24. Journaled in the front supports 6 are axles 33. Mounted on these axles 33 are large gears 32 which are positioned so as to be in mesh with the respective pinion gears 30. As the front wheel 24 rotates and causes rotation of the pinion gear 30, the large gear 32 will necessarily rotate.

Extending outward from the front support 6 is a support rod 34. The lower ends 36 of reciprocating arm levers 38 are mounted for rotation about the support rod 34. One way to do this is to provide an opening 40 in the lower end 36 of the arm levers and to place a bushing (not shown) in the opening and insert the lower end 36 onto the support rod 34. This structure would permit the arm lever 38 to rotate or pivot about the support rod 34. Any other method of connecting the arm lever 38 to the support rod 34 may also be used, provided that it permits rotation or pivoting of the arm lever in the manner hereinafter described. If desired, a footrest can be placed on the support rod 34, outside of the lower end 36 of the arm lever 38.

The arm levers 38 are generally made up of round tubing, and the upper end 44 is bent so as to define a handle portion. In the preferred embodiments, a handgrip may be placed on the distal ends of the handle portion 44.

Figure 2:
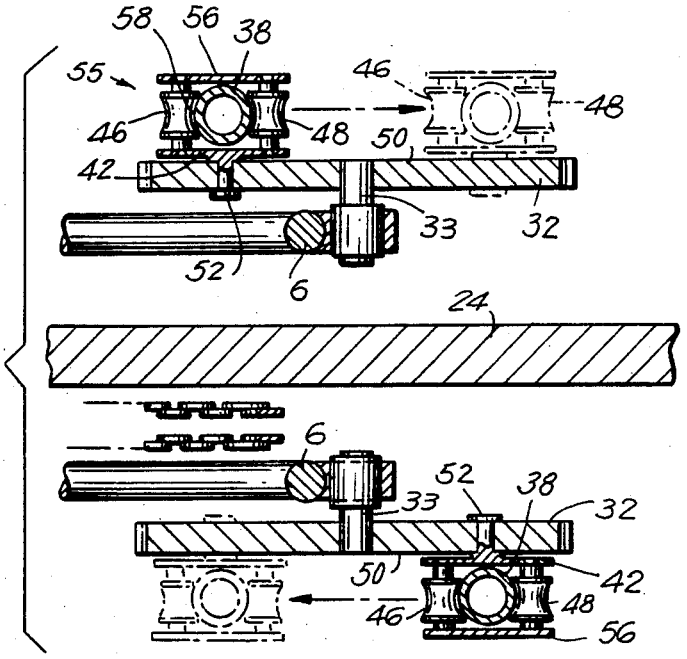
FIG. 2 is a cross-sectional view taken substantially along line 2—2 of FIG. 1.
Figure 3:
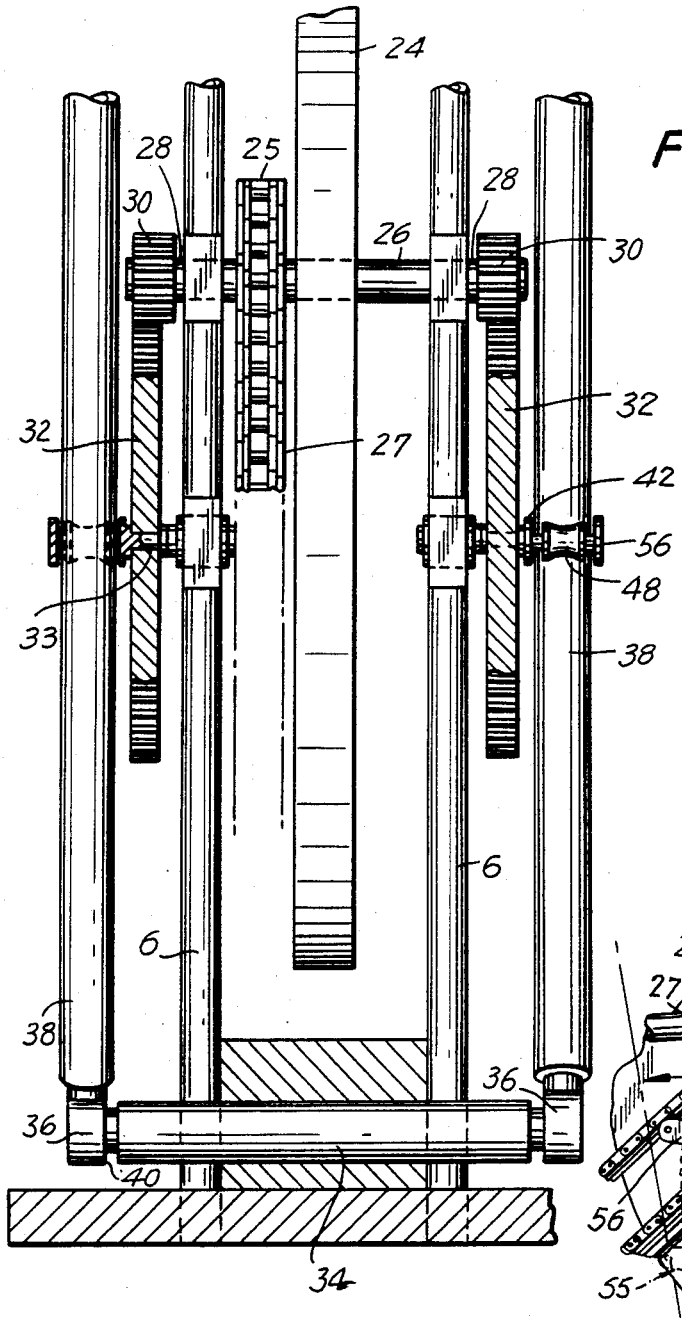
FIG. 3 is a cross-sectional view taken substantially along line 3—3 of FIG. 1.

A pin or bolt 52 passes through the large gear 32 and secures a bottom plate 42 relative to the outer surface 50 of the large gear 32. As shown in FIG. 2, it may be desirable to make the pin or bolt 52 integral with the bottom plate 42. Spindles 54 are used to attach a top plate 56 securely to the bottom plate 42, and rollers 46 and 48 are positioned for rotation on the said spindles 54. The entire structure that is made up by the pin 52, the plates 42 and 56, the spindles 54 and the rollers 46 and 48 serve to define an eccentric 55 which is used to connect the reciprocating arms 38 to the gear train 30 and 32. The pin or bolt 52 is mounted for rotation or rocking within the large gear 32, so that the eccentric 55, as a whole, is permitted some degree of rotation about the outer surface 50 of the large gear 32, as will be hereinafter described.

The arm levers 38 are positioned so that they pass between the plates 42 and 56 of the eccentric and bear against the rounded surfaces 58 of the rollers 46 and 48.

In order to use the exercise bicycle of this invention, the exerciser would sit on the exercise bicycle in a conventional fashion. He could use the foot pedals in the conventional manner and not use the reciprocating arm levers of this invention. Alternatively, he could use both the foot pedals and the reciprocating arm levers or just the arm levers without the foot pedals. Thus, this invention would provide three modes of exercise. In one mode only the lower body would be exercised, in another mode only the upper body would be exercised, and in the third mode both upper and lower portions of the body could be exercised.

Figure 4:
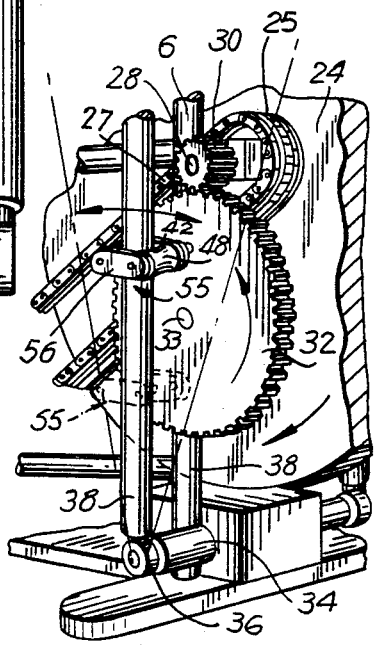
FIG. 4 is an enlarged perspective view showing the first and second gears and the eccentric of the invention.

In operation, the exerciser would reciprocate or move the arm levers 38 forwards and backwards. At one extreme point, the right arm lever would be forward and the left arm lever would be back, and at the other extreme point the positions would be reversed. As the arm levers are moved back and forth, they will pivot or rotate about the support rod 34. Because the arm levers 38 are held captive in the eccentric structure 55, this reciprocating or back and forth motion of the arm lever will necessarily cause rotation of the gear 32. Because the eccentric is free to float with respect to the surface 50 of the gear 32, the rollers 46 and 48 will maintain their respective positions and will securely hold the arm levers 38. As shown in FIG. 4, as the gear 32 rotates, the eccentric 55 rotates with it. Because the bolt 52 permits the eccentric's structure to slightly rotate or rock, the eccentric is able to maintain its position as the gear 32 rotates. In FIGS. 2 and 4, the eccentric is shown in phantom in different positions on the rotating gear 32.

This rotation of the gear 32 necessarily causes rotation of the pinion gear 30. As the pinion gear 30 is secured to the axle 26, rotation of the pinion gear causes rotation of the axle 26 and the front wheel 24.

In one embodiment of the invention, the ratio of the pinion gear 30 to the gear 32 is 1:9, but this can be changed or modified in order to make it easier or more difficult to reciprocate the arm levers.

In an alternate embodiment of the invention, it is possible for the pinion gear 30 to be eliminated and to simply use the large gear 32 which is secured to the axle 26. Such an arrangement would also come within the scope of the invention and would work.

In some embodiments, it may be desirable to provide an element to disengage the pedals when the exerciser is using only the arm levers 38, and not the foot pedals 14. Thus, the pedals will not rotate when only the arm levers are being used, and this will prevent the needless banging of the foot pedal against the lower legs of the exerciser. For this purpose, a one-way clutch 21 may be provided. In this way, the secondary sprocket 22 will engage the second primary sprocket 23 only when the pedals are being rotated by the feet of the exerciser, but it will not engage when the pedals are not rotated and only the flywheel 24 is being turned. In other words, when the exerciser is using the foot pedals 14, the one-way clutch 21 will engage, and the secondary sprocket 22 will cause rotation of the second primary sprocket 23; and, when the foot pedals are not used and the flywheel 24 is rotating by means of reciprocation of the arm levers 38, the one-way clutch will cause disengagement of the second primary sprocket and the second sprocket 22, thereby preventing rotation of the foot pedals 14. This one-way clutch is shown in FIG. 1, but it can be appreciated that it can be either included or not included at the option of the person making the invention. In some situations it may be advisable to include the one-way clutch between the second secondary sprocket 25 and the flywheel 24, instead of between the secondary sprocket 22 and the second primary sprocket 23.

I claim:

1. An exercise bicycle having a frame, a seat, foot pedal means, an energy absorbing wheel and means to link the foot pedal to the energy absorbing wheel, wherein the improvement comprises:

gear means affixed to an axle of said energy absorbing wheel for rotation with said energy absorbing wheel;

an eccentric means positioned on said gear means and including first and second roller freely rotatable on a face surface of said gear means; and reciprocating arm levers pivotally mounted on said frame, passing between said rollers of said eccentric means, and interacting with said eccentric means for rotation of said gear means and said energy absorbing wheel upon reciprocation of said arm levers.

2. An exercise bicycle according to claim 1, wherein said gear means includes a first gear positioned on said axle on said energy absorbing wheel; and a second gear in mesh with said first gear and mounted on said frame, and said eccentric means being positioned on said second gear.

3. An exercise bicycle according to claim 1 wherein said eccentric means further comprises a pin mounted for rotation on a face surface of said gear means, a first plate affixed to said pin, a second plate, and spindles connecting said first and second plates, and wherein said rollers are mounted on respective spindles.

4. An exercise bicycle according to claim 2, wherein said eccentric means further comprises a pin mounted for rotation on a face surface of said second gear, a first plate affixed to said pin, a second plate, and spindles connecting said first and second plates, and wherein said rollers are mounted on respective spindles.

5. An exercise bicycle according to claim 1 further comprising a means for disengaging the pedal means from the energy absorbing wheel when the reciprocating arm levers are causing rotation of said energy absorbing wheel.

6. An exercise bicycle according to claim 1, wherein said eccentric means further comprises a pin mounted for rotation on a surface of said second gear, a first plate affixed to said pin, a second plate, and spindles connecting said first and second plates, and wherein said rollers are mounted on respective spindles.

7. An exercise bicycle according to claim 1, wherein said eccentric means further comprises a pin mounted for rotation on a surface of said second gear, a first plate affixed to said pin, a second plate, and spindles connecting said first and second plates, and wherein said rollers are mounted on respective spindles.

* * * * *